US011151928B2

(12) United States Patent
Lee

(10) Patent No.: US 11,151,928 B2
(45) Date of Patent: Oct. 19, 2021

(54) FLEXIBLE DISPLAY DEVICE, AND METHOD OF OPERATING A FLEXIBLE DISPLAY DEVICE

(71) Applicant: SAMSUNG DISPLAY CO., LTD., Yongin-si (KR)

(72) Inventor: Jeong Kug Lee, Seoul (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/036,159

(22) Filed: Sep. 29, 2020

(65) Prior Publication Data

US 2021/0166612 A1 Jun. 3, 2021

(30) Foreign Application Priority Data

Dec. 2, 2019 (KR) ..... 10-2019-0158052

(51) Int. Cl.
*G09G 3/20* (2006.01)
*G09F 9/30* (2006.01)

(52) U.S. Cl.
CPC ..... *G09G 3/2092* (2013.01); *G09F 9/301* (2013.01); *G09G 2320/0233* (2013.01); *G09G 2320/0276* (2013.01); *G09G 2320/0673* (2013.01); *G09G 2380/02* (2013.01)

(58) Field of Classification Search
CPC ..... G09G 2320/0233; G09G 3/2092; G09G 2320/0276; G09G 2320/0673; G09G 2380/02; G09F 9/301
See application file for complete search history.

(56) References Cited

U.S. PATENT DOCUMENTS

2015/0301636 A1* 10/2015 Akimoto ..... G06F 3/04184 345/173
2020/0066219 A1* 2/2020 Hsu ..... G09G 3/006
2020/0202774 A1* 6/2020 Cho ..... G06F 1/1677

FOREIGN PATENT DOCUMENTS

KR 1020170067199 6/2017
KR 1020170087088 7/2017
KR 1020180130071 6/2018

* cited by examiner

*Primary Examiner* — Muhammad N Edun

(74) *Attorney, Agent, or Firm* — F. Chau & Associates, LLC

(57) ABSTRACT

A flexible display device includes a flexible display panel that includes a display region, a gamma data storage that stores entire driving gamma data generated by a first multi-time programming for an entirety of the display region, and partial driving gamma data generated by a second multi-time programming for a portion of the display region, a gamma reference voltage generator that generates a gamma reference voltage based on the entire driving gamma data when the flexible display panel is not deformed, and generates the gamma reference voltage based on the partial driving gamma data when the flexible display panel is deformed, and a data driver that provides data voltages to the flexible display panel based on the gamma reference voltage.

20 Claims, 17 Drawing Sheets

FIG. 11

510

| | ENTIRE DRIVING | PARTIAL DRIVING (1-FOLD) | PARTIAL DRIVING (2-FOLD) |
|---|---|---|---|
| LUMINANCE (nit) | 420 | 453 | 475 |
| POWER CONSUMPTION | 100% | 58% | 42% |

530

| | ENTIRE DRIVING | PARTIAL DRIVING (1-FOLD) | PARTIAL DRIVING (2-FOLD) |
|---|---|---|---|
| LUMINANCE (nit) | 420 | 420 | 420 |
| POWER CONSUMPTION | 100% | 54% | 37% |

$$IGD = \frac{W1*PDGD + W2*EDGD}{W1 + W2}$$

FLEXIBLE DISPLAY DEVICE, AND METHOD OF OPERATING A FLEXIBLE DISPLAY DEVICE

CROSS-REFERENCE TO RELATED APPLICATION(S)

This application claims priority under 35 USC § 119 from, and the benefit of, Korean Patent Application No. 10-2019-0158052, filed on Dec. 2, 2019 in the Korean Intellectual Property Office (KIPO), the contents of which are herein incorporated reference in their entirety.

BACKGROUND

1. Technical Field

Exemplary embodiments are directed to a display device, and more particularly to a flexible display device, and a method of operating the flexible display device.

2. Discussion of the Related Art

Flexible display devices, such as a foldable display device or a rollable display device having a display panel, at least a portion of which is deformable, have been recently developed. A flexible display device can be deformed such that a partial region of a display panel is viewed by a user, but the remaining region of the display panel is not viewed by a user. In this case, to reduce power consumption, a flexible display device drives only the partial region of the display panel that is can be viewed by a user. However, when a flexible display device drives only a partial region of the display panel, a display panel load is reduced compared with a display panel load when the entire region is driven, and thus luminance of the display panel may increase as compared with a desired luminance.

SUMMARY

Some exemplary embodiments provide a flexible display device that improves a display quality of a deformed flexible display panel.

Some exemplary embodiments provide a method of operating a flexible display device capable of improving a display quality of a deformed flexible display panel.

According to exemplary embodiments, there is provided a flexible display device that includes a flexible display panel that includes a display region, a gamma data storage that stores entire driving gamma data generated by a first multi-time programming for an entirety of the display region, and partial driving gamma data generated by a second multi-time programming for a portion of the display region, a gamma reference voltage generator that generates a gamma reference voltage based on the entire driving gamma data when the flexible display panel is not deformed, and generates the gamma reference voltage based on the partial driving gamma data when the flexible display panel is deformed, and a data driver that provides data voltages to the flexible display panel based on the gamma reference voltage.

In exemplary embodiments, the flexible display panel is an out-foldable display panel, and a deformed state of the flexible display panel is a state where the out-foldable display panel is folded.

In exemplary embodiments, the partial driving gamma data is generated by driving one of an upper half, a lower half or a middle half of the display region of the out-foldable display panel.

In exemplary embodiments, the gamma reference voltage generator generates the gamma reference voltage based on the entire driving gamma data when the out-foldable display panel is not folded, and generates the gamma reference voltage based on the partial driving gamma data when the out-foldable display panel is folded.

In exemplary embodiments, the flexible display panel is a foldable display panel that has two folding lines, and a deformed state of foe flexible display panel is a state where foe foldable display panel is folded around at least one of the two folding lines.

In exemplary embodiments, the partial driving gamma data includes two-thirds driving gamma data generated by driving two-thirds of the display region of foe foldable display panel, and one-third driving gamma data generated by driving one-third of the display region of foe foldable display panel.

In exemplary embodiments, the gamma reference voltage generator generates the gamma reference voltage based on the entire driving gamma data when the foldable display panel is not folded, generates the gamma reference voltage based on foe two-thirds driving gamma data when the foldable display panel is folded at one of the two folding lines, and generates the gamma reference voltage based on the one-third driving gamma data when the foldable display panel is folded at both of the two folding lines.

In exemplary embodiments, the flexible display panel is a rollable display panel, and a deformed state of the flexible display panel is a state where foe rollable display panel is tolled.

In exemplary embodiments, the partial driving gamma data includes minimum area driving gamma data generated by driving a portion of the display region of the reliable display panel, wherein the portion of the display region has a predetermined minimum area.

In exemplary embodiments, the gamma reference voltage generator generates the gamma reference voltage based on foe entire driving gamma data when foe reliable display panel is unrolled. When the reliable display panel is rolled, the gamma reference voltage generator generates interpolated gamma data by interpolating the minimum area driving gamma data and the entire driving gamma data, and generates the gamma reference voltage based on the interpolated gamma data.

In exemplary embodiments, the flexible display device further includes a controller that receives deformation information indicative of whether or not the flexible display panel is deformed, and controls the gamma reference voltage generator based on the deformation information.

In exemplary embodiments, the flexible display device further includes a controller that receives deformation information indicative of a deformation degree of the flexible display panel, and provides a deformation level signal that corresponds to the deformation degree to the gamma reference voltage generator.

In exemplary embodiments, the flexible display panel is an out-foldable display panel, and the deformation degree indicated by the deformation information corresponds to a folding angle of the out-foldable display panel.

In exemplary embodiments, the gamma reference voltage generator generates interpolated gamma data by interpolating the partial driving gamma data and the entire driving gamma data based on the deformation level signal, and generates the gamma reference voltage based on the interpolated gamma data.

In exemplary embodiments, the gamma reference voltage generator multiplies the partial driving gamma data by a first weight that continuously increases as the deformation degree increases, multiplies the entire driving gamma data by a second weight that continuously decreases as the deformation degree increases, and generates the interpolated gamma data by dividing a sum of the partial driving gamma data multiplied by the first weight and the entire driving gamma data multiplied by the second weight by a sum of the first weight and the second weight.

In exemplary embodiments, the controller continuously decreases image data for an unviewable portion of the display region such that luminance of the unviewable portion of the display region continuously decreases as the deformation degree of the flexible display panel increases.

According to exemplary embodiments, there is provided a method of operating a flexible display device that includes a flexible display panel that includes a display region. The method includes storing entire driving gamma data generated by a first multi-time programming for an entirety of the display region, storing partial driving gamma data generated by a second multi-time programming for a portion of the display region, receiving deformation information that indicates whether or not the flexible display panel is deformed, generating a gamma reference voltage based on the entire driving gamma data when the deformation information indicates that flexible display panel is not deformed, generating the gamma reference voltage based on the partial driving gamma data when the deformation information indicates that the flexible display panel is deformed, and driving the flexible display panel based on the gamma reference voltage to display an image.

According to exemplary embodiments, there is provided a method of operating a flexible display device that includes a flexible display panel that includes a display region. The method includes storing entire driving gamma data generated by a first multi-time programming for an entirety of the display region, storing partial driving gamma data generated by a second multi-time programming for a portion of the display region, receiving deformation information indicative of a deformation degree of the flexible display panel, generating a gamma reference voltage based on the entire driving gamma data when the deformation information indicates that the deformation degree is 0, generating interpolated gamma data by interpolating the partial driving gamma data and the entire driving gamma data based on the deformation degree when the deformation information indicates that the deformation degree is not equal to 0, generating the gamma reference voltage based on the interpolated gamma data, and driving the flexible display panel based on the gamma reference voltage to display an image.

In exemplary embodiments, generating the interpolated gamma data includes multiplying the partial driving gamma data by a first weight that continuously increases as the deformation degree increases, multiplying the entire driving gamma data by a second weight that continuously decreases as the deformation degree increases, and generating the interpolated gamma data by dividing a sum of the partial driving gamma data multiplied by the first weight and the entire driving gamma data multiplied by the second weight by a sum of the first weight and the second weight.

In exemplary embodiments, the method includes continuously decreasing image data for an unviewable portion of the display region such that a luminance of the unviewable portion of the display region continuously decreases as the deformation degree of the flexible display panel increases.

As described above, in a flexible display device and a method of operating the flexible display device according to exemplary embodiments, entire driving gamma data generated by a first multi-time programming for an entirety of a display region of a flexible display panel is stored, partial driving gamma data generated by a second multi-time programming for a portion of the display region is stored, a gamma reference voltage is generated based on the entire driving gamma data when the flexible display panel is not deformed, and the gamma reference voltage is generated based on the partial driving gamma data when the flexible display panel is deformed. Accordingly, an undesirable increase of a luminance of the flexible display panel can be prevented when it is deformed, and power consumption of the flexible display device can be reduced.

BRIEF DESCRIPTION OF THE DRAWINGS

FIG. 11 illustrates tables of luminance and power consumption of a flexible display device using single gamma data and of luminance and power consumption of a flexible display device that uses entire driving gamma data and partial driving gamma data.

DETAILED DESCRIPTION OF EXEMPLARY EMBODIMENTS

Hereinafter, exemplary embodiments of the present inventive concept will be explained in detail with reference to the accompanying drawings.

Figure 1:
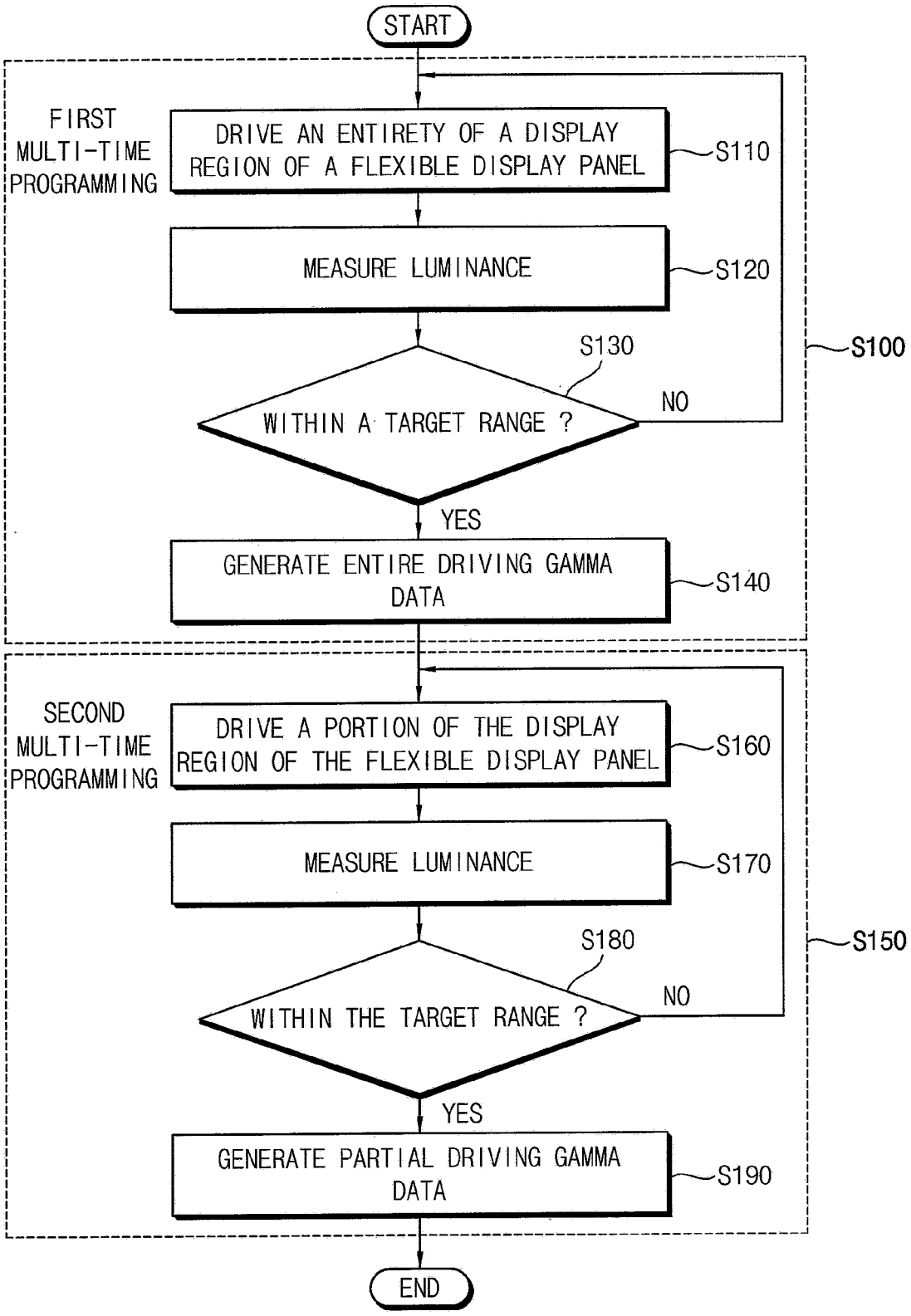
FIG. 1 is a flowchart of a method of generating gamma data for a flexible display device according to exemplary embodiments.
Figure 2:
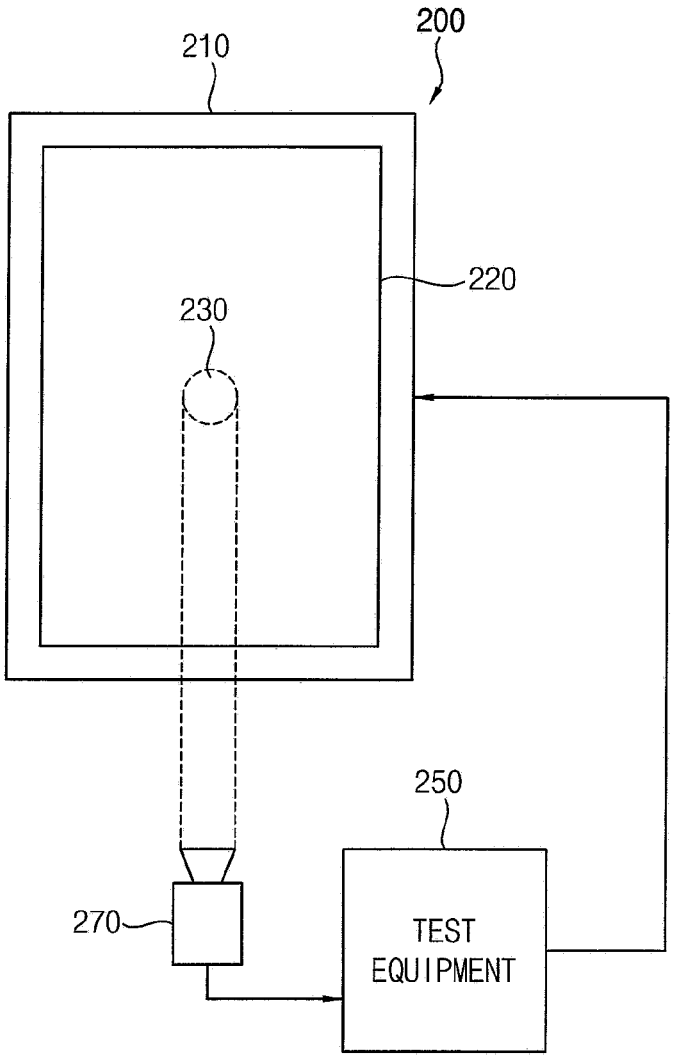
FIG. 2 is a block diagram of an example of test equipment that performs a method of FIG. 1.
Figure 3A:
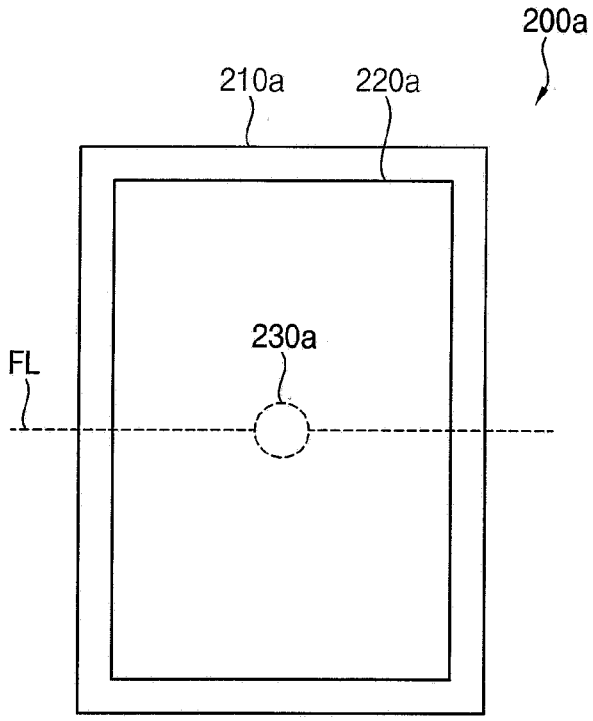
FIG. 3A illustrate an example where driving gamma data for an entire out-foldable display panel are generated.
Figure 3B:
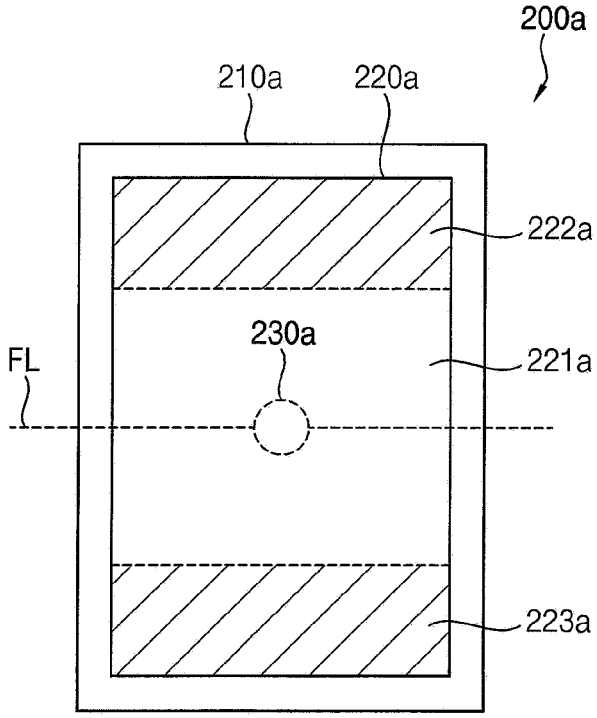
FIGS. 3B through 3D illustrate examples where driving gamma data for a partial out-foldable display panel are generated.
Figure 3C:
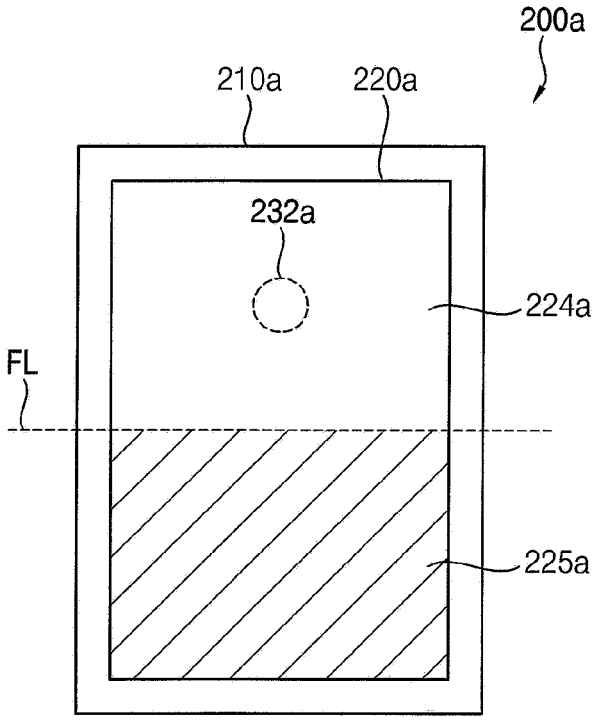
Figure 3D:
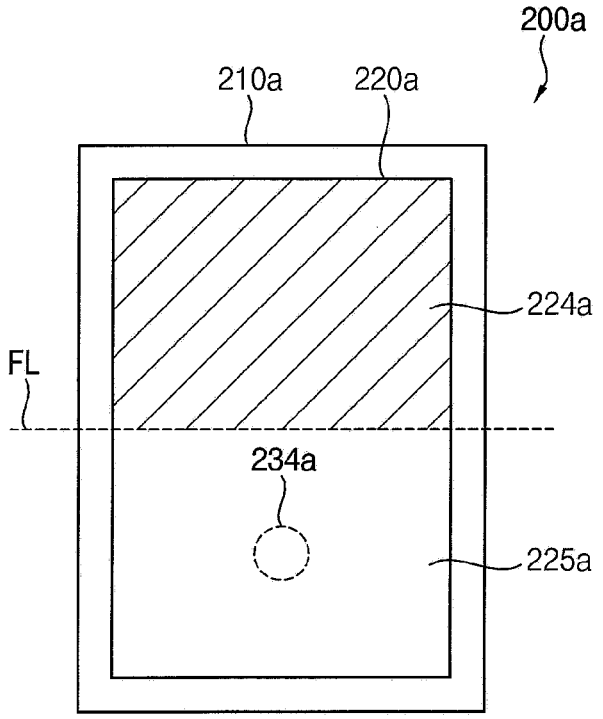
Figure 4A:
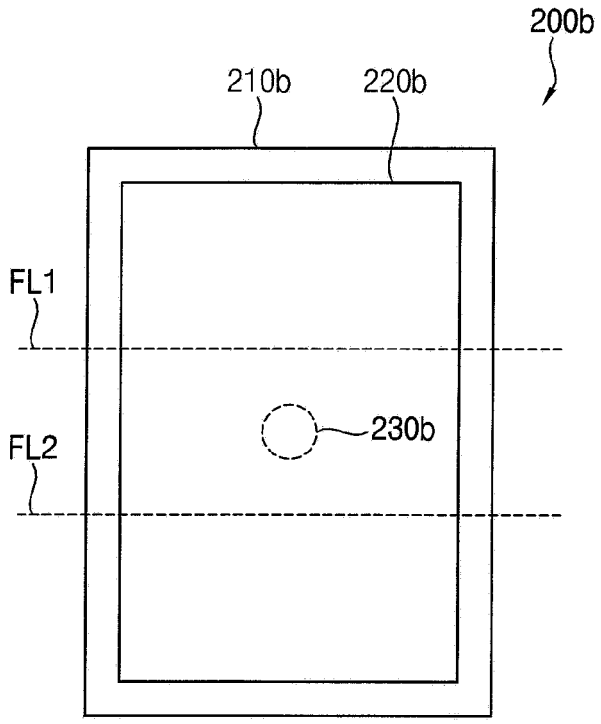
FIG. 4A illustrates an example where driving gamma data for an entire foldable display panel that has two or more folding lines are generated.
Figure 4B:
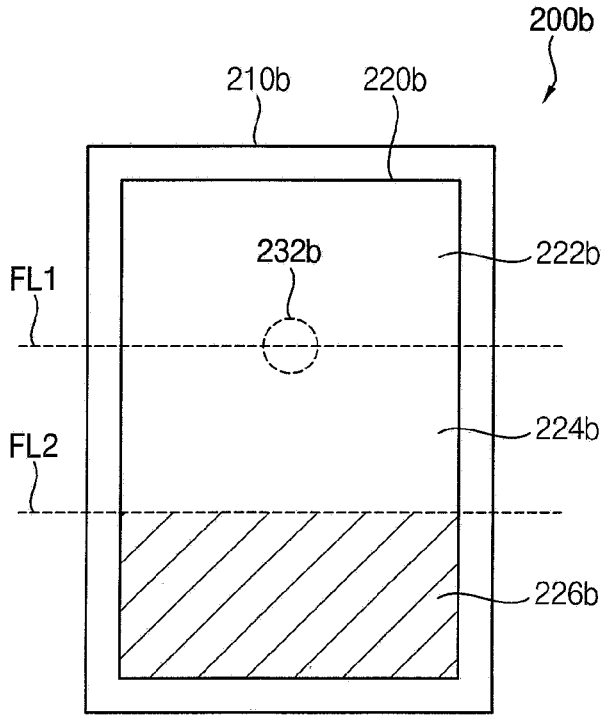
FIG. 4B illustrates an example where driving gamma data for two thirds of a foldable display panel are generated.
Figure 4C:
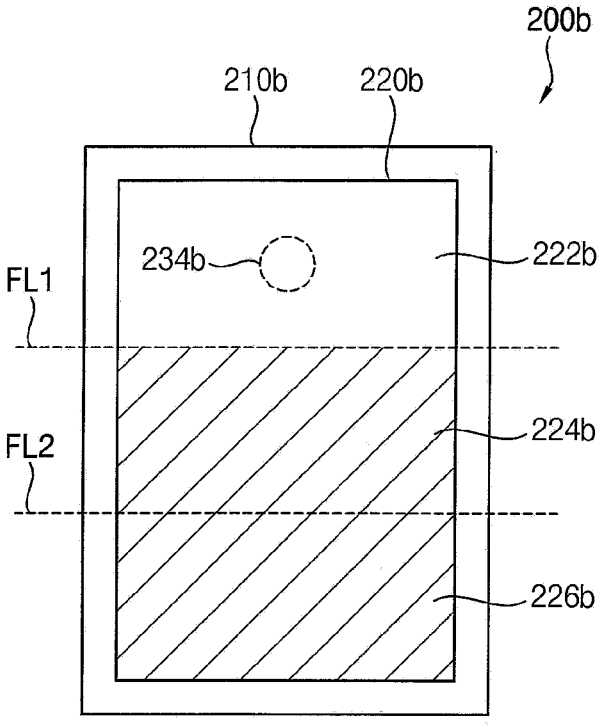
FIG. 4C illustrates an example where driving gamma data for one third of a foldable display panel are generated.
Figure 5A:
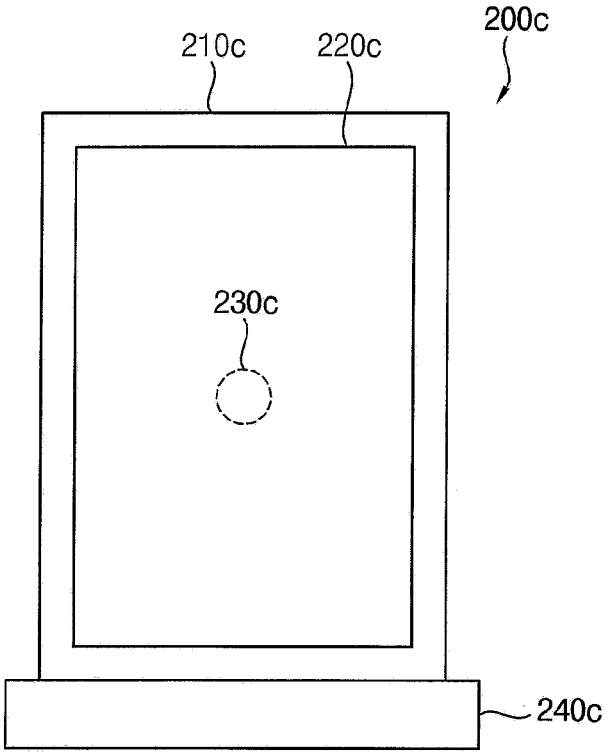
FIG. 5A illustrates an example where driving gamma data for an entire reliable display panel are generated.
Figure 5B:
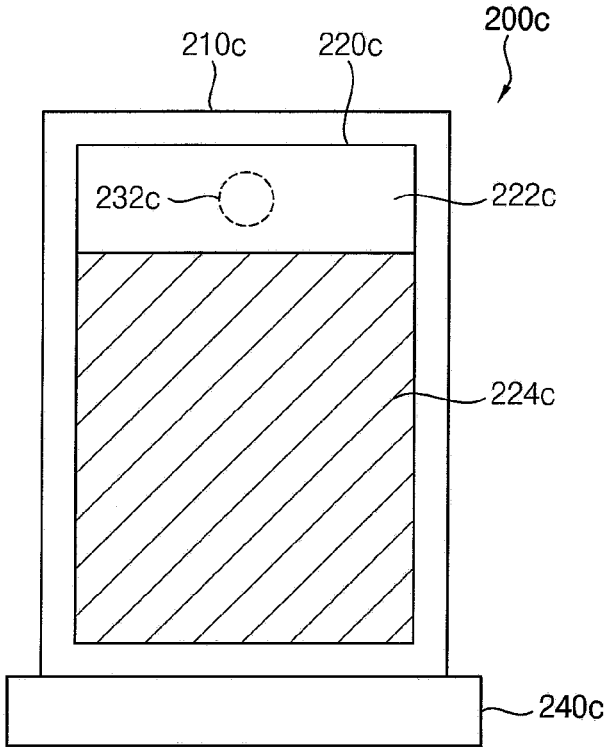
FIG. 5B illustrates an example where driving gamma data for a minimum area of a rollable display panel are generated.

FIG. 1 is a flowchart of a method of generating gamma data for a flexible display device according to exemplary embodiments, FIG. 2 is a block diagram of an example of test equipment that performs a method of FIG. 1, FIG. 3A illustrates an example where driving gamma data for an entire out-foldable display panel are generated, FIGS. 3B through 3D illustrate examples where driving gamma data for a partial out-foldable display panel are generated, FIG. 4A illustrates an example where driving gamma data for an entire foldable display panel that has two or more folding lines are generated, FIG. 4B illustrates an example where driving gamma data for two thirds of a foldable display panel are generated, FIG. 4C illustrates an example where driving gamma data for one third of a foldable display panel are generated, FIG. 5A illustrates an example where driving gamma data for an entire rollable display panel are generated, and FIG. 5B illustrates an example where minimum area driving gamma data for a minimum area of a rollable display panel are generated.

Referring to FIGS. 1 and 2, according to exemplary embodiments, a method of generating compensation data for a flexible display device 200 includes both a first multi-time programming (MTP) (S100) for an entirety of a display region 220 of a flexible display panel 210, and a second multi-time programming (S150) for a portion of the display region 220 of the flexible display panel 210.

According to an embodiment, the first multi-time programming (S100) includes driving the entirety of the display region 220 of the flexible display panel 210 to display one or more images at one or more reference gray levels, such as a 0-gray level, a 1-gray level, a 11-gray level, a 23-gray level, a 35-gray level, a 51-gray level, a 87-gray level, a 151-gray level, a 203-gray level or a 255-gray level, (S110), measuring a luminance and/or a color coordinate of the flexible display panel 210 (S120), and determining whether the measured luminance and/or the measured color coordinate is within a desired target range (S130). For example, as illustrated in FIG. 2, test equipment 250 provides test image data for the entirety of the display region 220 to the flexible display device 200, the flexible display device 200 applies a predicted gamma reference voltage at the reference gray level to the entirety of the display region 220 based on the test image data, and the test equipment 250 measures luminance at a center portion 230 of the display region 220 using a camera, such as a charge coupled device (CCD) camera 270. In a case where the measured luminance is out of the target range (S130: NO), the entirety of the display region 220 of the flexible display panel 210 is driven again by changing the predicted gamma reference voltage (S110), and measuring again the luminance at the center portion 230 of the display region 220 that emits light in response to the changed gamma reference voltage (S120). In a case where the measured luminance is within the target range (S130: YES), a value of the gamma reference voltage applied to the entirety of the display region 220 is determined as a gamma reference voltage value at the reference gray level for the entirety of the display region 220. In some exemplary embodiments, determining the gamma reference voltage value is performed with respect to each of a plurality of reference gray levels. If the gamma reference voltage values at the plurality of reference gray levels for the entirety of the display region 220 are determined, driving gamma data that represents the gamma reference voltage values at the plurality of reference gray levels for the entirety of the display region 220, referred to herein as entire driving gamma may be generated, and the entire driving gamma data may be stored in the flexible display device 200 (S140).

Further, according to an embodiment, the second multi-time programming (S150) includes driving a portion of the display region 220 of the flexible display panel 210 to display one or more images at the one or more reference gray levels (S160), measuring a luminance and/or a color coordinate of the flexible display panel 210 (S170), and determining whether the measured luminance and/or the measured color coordinate is within the desired target range (S180). For example, a luminance at a center portion of the portion of the display region 220 is measured. In some exemplary embodiments, a data voltage is not applied to the remaining portion of the display region 220. In other exemplary embodiments, a data voltage corresponding to black, i.e., a 0-gray level, is applied to the remaining portion of the display region 220. In a case where the measured luminance is out of the target range (S180: NO), the portion of the display region 220 is driven again by changing the desired gamma reference voltage (S160), and measuring again the luminance at the center portion of the portion of the display region 220 that emits light in response to the changed gamma reference voltage (S170). In a case where the measured luminance is within the target range (S180: YES), a value of the gamma reference voltage applied to the portion of the display region 220 is determined as a gamma reference voltage value at the reference gray level for the portion of the display region 220. In some exemplary embodiments, determining the gamma reference voltage value is performed with respect to each of the plurality of reference gray levels. If the gamma reference voltage values at the plurality of reference gray levels for the portion of the display region 220 are determined, driving gamma data that representing the gamma reference voltage values at the plurality of reference gray levels for the portion of the display region 220, referred to herein as partial driving gamma data, are generated, and the partial driving gamma data can be stored in the flexible display device 200 (S190).

In some exemplary embodiments, as illustrated in FIGS. 3A through 3D or FIG. 8, the flexible display device 200 is an out-foldable display device 200*a* that has one folding line FL, and the flexible display panel 210 is an out-foldable display panel 210*a*. As illustrated in FIG. 3A, the first multi-time programming (S100) for the out-foldable display device 200*a* is performed by driving the entirety of the display region 220*a* of the out-foldable display panel 210*a* and measuring luminance at the center portion 230*a* of the display region 220*a*. In some exemplary embodiments, as illustrated in FIG. 3B, the second multi-time programming (S150) for the out-foldable display device 200*a* is performed by driving a middle half 221*a* of the display region 220*a* of the out-foldable display panel 210*a* and measuring luminance at the center portion 230*a* of the middle half 221*a*, or the center portion 230*a* of the display region 220*a*. When the second multi-time programming (S150) is performed, no data voltages, or data voltages that correspond to a black image, such as a 0-gray level, are applied to the remaining portions 222*a* and 223*a* of the display region 220*a*. In other exemplary embodiments, as illustrated in FIG. 3C, the second multi-time programming (S150) for the out-foldable display device 200*a* is performed by driving an upper half 224*a* of the display region 220*a* and measuring luminance at the center portion 232*a* of the upper half 224*a*. When the second multi-time programming (S150) is performed, no data voltages, or data voltages that correspond to a black image are applied to a lower half 225*a* of the display region 220*a*. In still other exemplary embodiments, as illustrated in FIG. 3D, the second multi-time programming (S150) for the out-foldable display device 200*a* is performed by driving the lower half 225*a* of the display region 220*a* of the out-foldable display panel 210*a* and measuring luminance at the center portion 234*a* of the lower half 225*a*. When foe second multi-time programming (S150) is performed, no data voltages or data voltages that correspond to a black image, are applied to the upper half 224*a* of foe display region 220*a*. Although FIGS. 3B through 3D illustrate examples where foe middle half 221*a*, foe upper half 224*a* or the lower half 225*a* of the display region 220*a* of foe out-foldable display panel 210*a* are driven to perform foe second multi-time programming (S150), according to exemplary embodiments, any continuous or discontinuous portion of the display region 220*a* of the out-foldable display panel 210*a* can driven to perform the second multi-time programming (S150). Although the portion illustrated in FIGS. 3B to 3D is half of the display region 220*a*, with the folding line FL in the middle of the display region 220*a* and dividing the display region 220*a* in half, embodiments are not limited thereto, and in other embodiments, the folding line FL is not in the middle of the display region 220*a* and the portion is some other fraction of the display region 220*a*.

In other exemplary embodiments, as illustrated in FIGS. 4A through 4C or FIGS. 9A and 9B, the flexible display device 200 is a foldable display device 200*b* that has two or more folding lines FL1 and FL2, and the flexible display panel 210 is a foldable display panel 210*b*. As illustrated in FIG. 4A, the first multi-time programming (S100) for the foldable display device 200*b* is performed by driving the entirety of the display region 220*b* of the foldable display panel 210*b* and measuring luminance at the center portion 230*b* of the display region 220*b*. In some exemplary embodiments, the second multi-time programming (S150) for the foldable display device 200*b* includes a multi-time programming for two-thirds of the display region 220*b* of the foldable display panel 210*b* as illustrated in FIG. 4B, and a multi-time programming for one-third of the display region 220*b* of the foldable display panel 210*b* as illustrated in FIG. 4C. As illustrated in FIG. 4B, the multi-time programming for the two-thirds of the display region 220*b* of the foldable display panel 210*b* is performed by driving the two-thirds 222*b* and 224*b* of the display region 220*b* of the foldable display panel 210*b* and measuring luminance at the center portion 232*b* of the two-thirds 222*b* and 224*b* of the display region 220*b*. Further, no data voltages or data voltages that correspond to a black image, are applied to the one-third 226*b* of the display region 220*b*. Driving gamma data, known as two thirds driving gamma data, are generated by the multi-time programming for the two-thirds of the display region 220*b* of the foldable display panel 210*b*. Further, as illustrated in FIG. 4C, the multi-time programming for the one-third of the display region 220*b* of the foldable display panel 210*b* is performed by driving the one-third 222*b* of the display region 220*b* of the foldable display panel 210*b* and measuring luminance at the center portion 234*b* of the one-third 222*b* of the display region 220*b*. Further, no data voltages, or data voltages that correspond to a black image, are applied to the two-thirds 224*b* and 226*b* of the display region 220*b*. Driving gamma data, known as one-third driving gamma data, is generated by the multi-time programming for the one-third of the display region 220*b* of the foldable display panel 210*b*. Thus, in some exemplary embodiments, the partial driving gamma data for the foldable display device 200*b* that has two folding lines FL1 and FL2 includes the two-thirds driving gamma data generated by driving the two-thirds 222*b* and 224*b* of the display region 220*b* of the foldable display panel 210*b*, and the one-third driving gamma data generated by driving the one-third 222*b* of the display region 220*b* of the foldable display panel 210*b*. Although FIGS. 4B and 4C illustrate examples where the two-thirds 222*b* and 224*b* and the one-third 222*b* of the display region 220*b* of the foldable display panel 210*b* are driven to perform the second multi-time programming (S150), according to exemplary embodiments, any continuous or discontinuous two-thirds and any continuous or discontinuous one-third of the display region 220*b* of the foldable display panel 210*b* can be driven to perform the second multi-time programming (S150). In addition, although FIGS. 4B and 4C illustrate the folding lines FL1, FL2 as dividing the display region 220*b* in thirds, embodiments axe not limited thereto, and in other embodiments, the two folding line FL1, FL2 do not divide the display region 220*b* in thirds.

Figure 10:
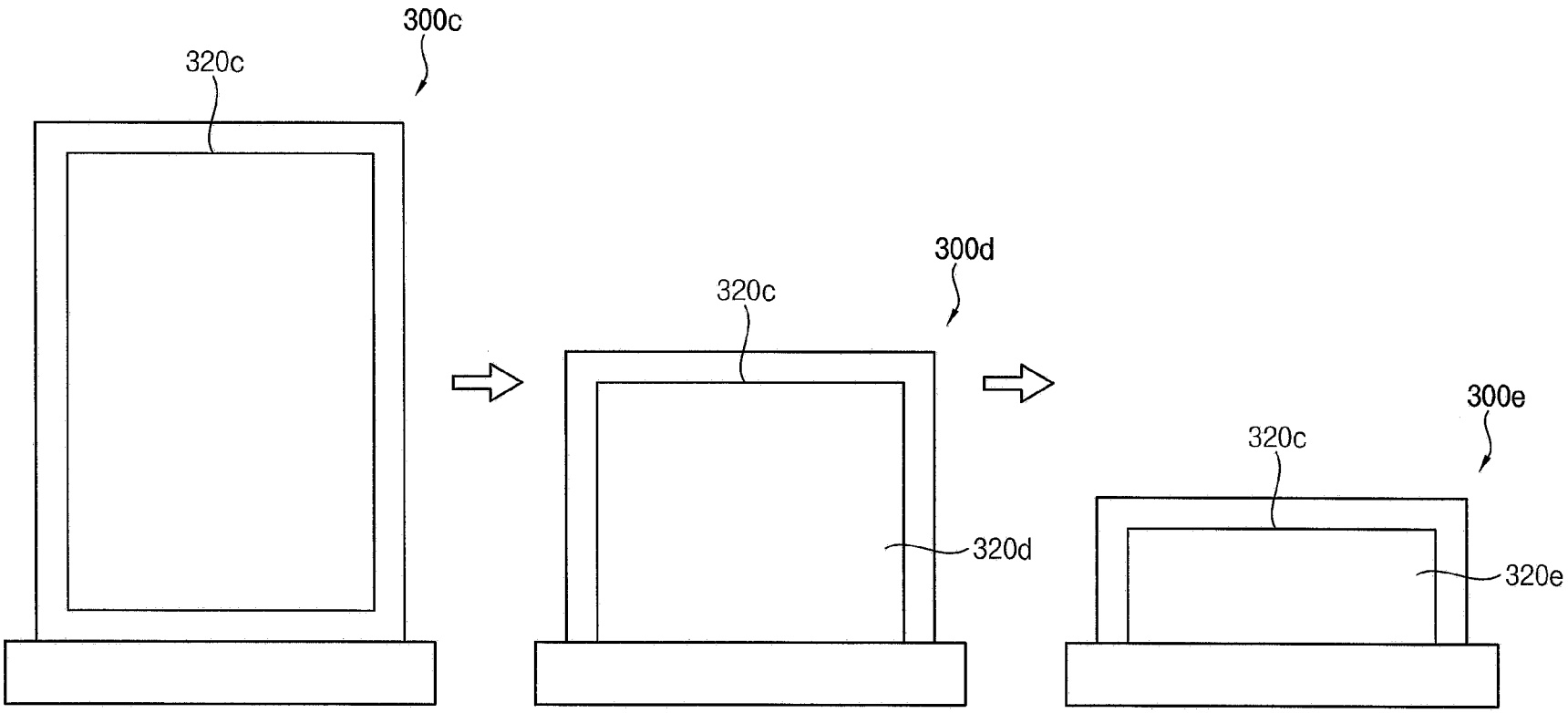
FIG. 10 illustrates examples of a flexible display device that includes a rollable display panel when it is both not deformed and deformed.

In still other exemplary embodiments, as illustrated in FIGS. 5A and 5B or FIG. 10, the flexible display device 200 is a reliable display device 200*c*, and the flexible display panel 210 is a reliable display panel 210*c*. For example, the reliable display device 200*c* includes a receiving part 240*c*, and can be rolled such that at least a portion of the display region 220*c* of the rollable display panel 210*c* is received in the receiving part 240*c*. As illustrated in FIG. 5A, the first multi-time programming (S100) for the rollable display device 200*c* is performed by driving the entirety of the display region 220*c* of the rollable display panel 210*c* and measuring luminance at the center portion 230*c* of the display region 220*c*. As the display region 220*c* of the rollable display panel 210*c* is received in the receiving part 240*c*, an area of the display region 220*c* that is externally exposed can be decreased. In some exemplary embodiments, when the rollable display panel 210*c* is driven to display an image, the minimum area of the display region 220*c* that is externally exposed is predetermined. Further, as illustrated in FIG. 5B, the second multi-time programming (S150) for the rollable display device 200*c* is performed by driving the portion 222*c* of the display region 220*c* that has the predetermined minimum area and measuring luminance at the center portion 232*c* of the portion 222*c* of the display region 220*c*. Further, no data voltages, or data voltages that correspond to a black image, are applied to the remaining portion 224*c* of the display region 220*c*. Driving gamma data, referred to herein as minimum area driving gamma data, are generated by the second multi-time programming (S150) for the portion 222*c* of the display region 220*c* of the rollable display panel 210*c*, and the partial driving gamma data for the rollable display device 200*c* include the minimum area driving gamma data. Although FIG. 5B illustrates an example where the predetermined minimum area portion 222*c* of the display region 220*c* is driven to perform the second multi-time programming (S150), according to exemplary embodiments, any continuous or discontinuous portion of the display region 220*c* that has the predetermined minimum area can be driven to perform the second multi-time programming (S150).

In some exemplary embodiments, as illustrated in FIGS. 3A through 5B, not only the first multi-time programming (S100), but also the second multi-time programming (S150) can be performed when the flexible display panel 210 is not deformed. Accordingly, the flexible display panel 210 is not deformed until the flexible display device 200 is sold to a user. In other exemplary embodiments, the second multi-time programming (S150) is performed when the flexible display panel 210 is deformed.

Figure 6:
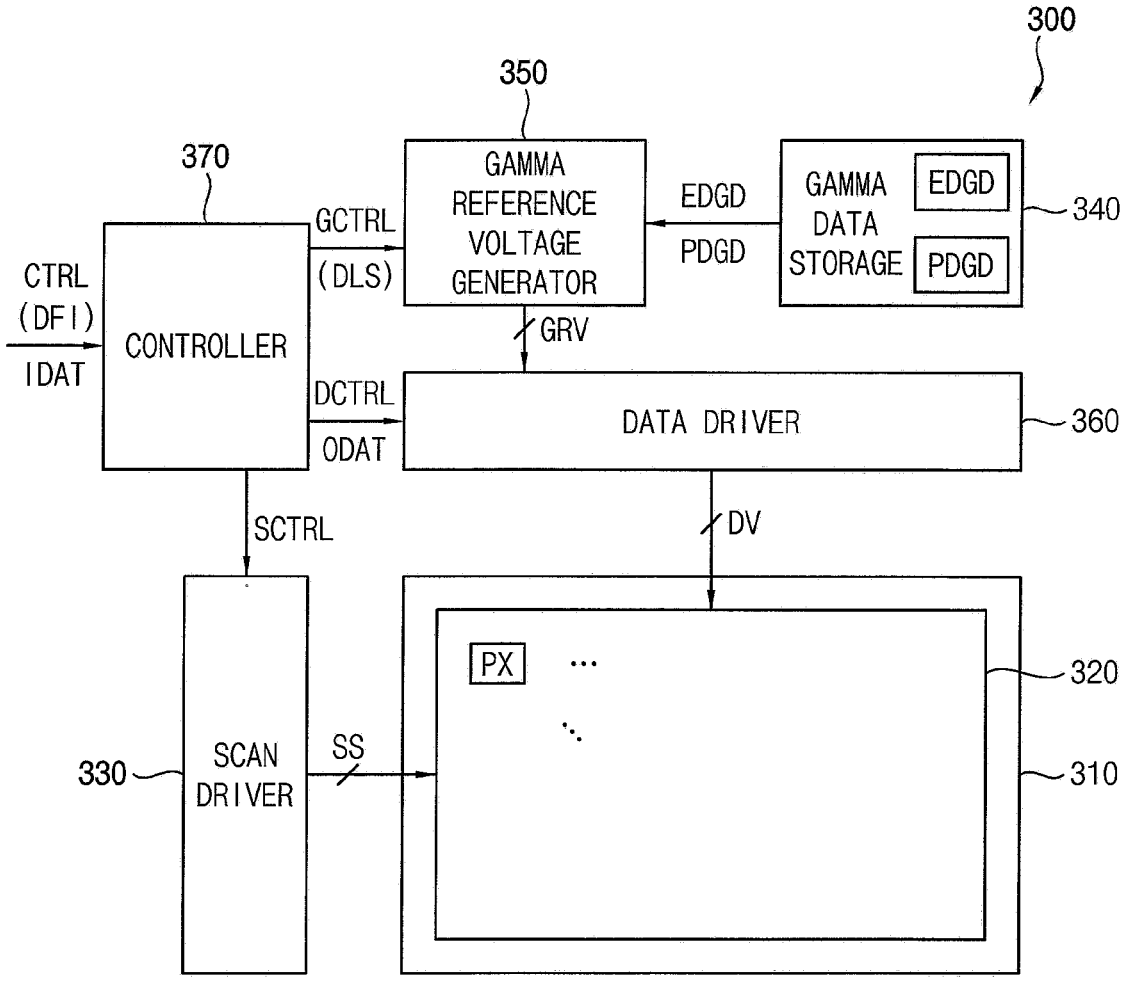
FIG. 6 is a block diagram of a flexible display device according to exemplary embodiments.

FIG. 6 is a block diagram of a flexible display device according to exemplary embodiments.

Referring to FIG. 6, a flexible display device 300 according to exemplary embodiments includes a flexible display panel 310 that has a display region 320, a gamma data storage 340, a gamma reference voltage generator 350 and a data driver 360. In some exemplary embodiments, the flexible display device 300 further includes a scan driver 330 and a controller 370.

Figure 8:
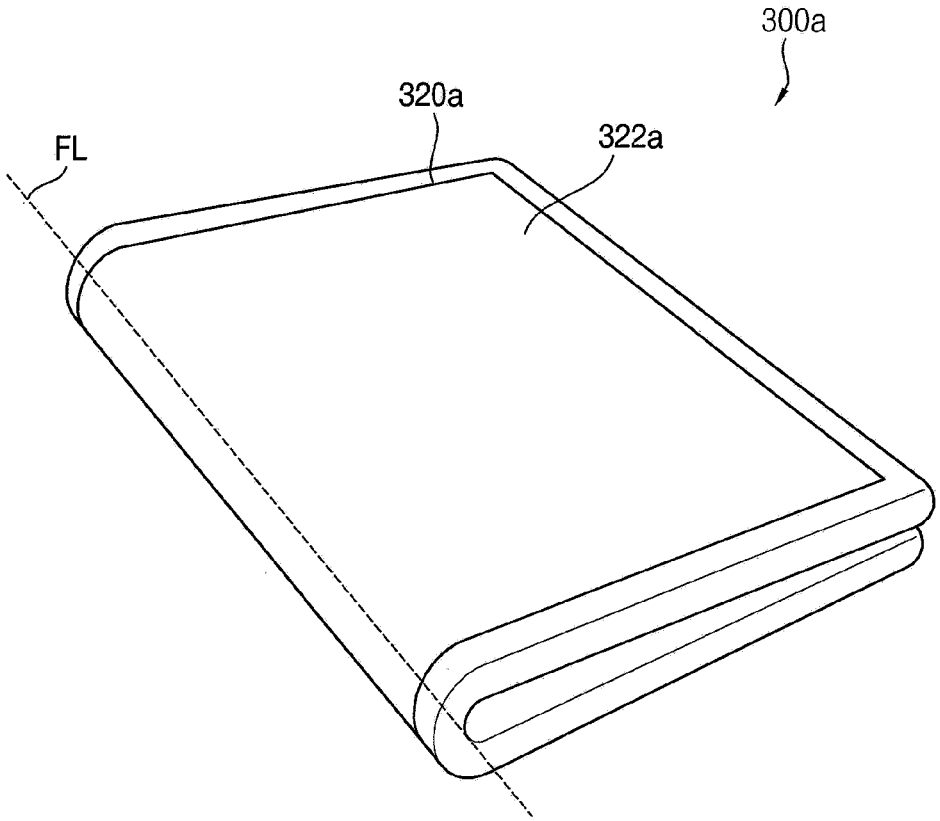
FIG. 8 illustrates an example of a flexible display device that includes an out-foldable display panel when it is deformed.
Figure 9A:
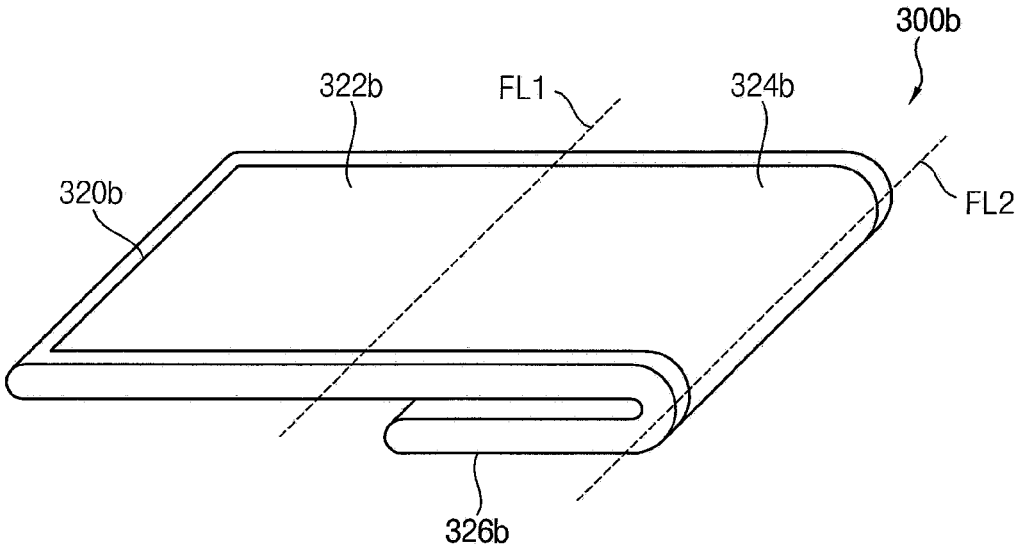
FIGS. 9A and 9B illustrate examples of a flexible display device that includes a deformed foldable display panel that has two folding lines.
Figure 9B:
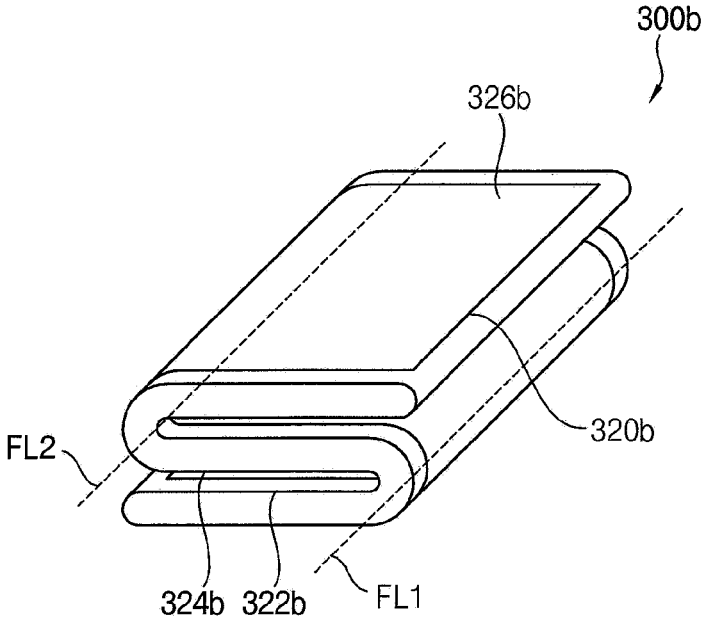

According to an embodiment, the flexible display panel 310 includes a plurality of pixels PX in the display region 320. In some exemplary embodiments, the flexible display panel 310 is an organic light emitting diode (OLED) display panel where each pixel PX includes an organic light emitting diode. In other exemplary embodiments, the flexible display panel 310 is a liquid crystal display (LCD) panel, or any other suitable panel. Further, in some exemplary embodiments, the flexible display panel 310 is an out-foldable display panel of an out-foldable display device 300*a* as illustrated in FIG. 8. In other exemplary embodiments, the flexible display panel 310 is a foldable display panel of a foldable display device 300*b* that has two folding lines FL1 and FL2 as illustrated in FIGS. 9A and 9B. In still other exemplary embodiments, the flexible display panel 310 is a rollable display panel of a rollable display device 300*c* as illustrated in FIG. 10. In still other exemplary embodiments, the flexible display panel 310 is any flexible display panel, such as a curved display panel, a bent display panel, or a stretchable display panel, etc.

According to an embodiment, the scan driver 330 generates and transmits scan signals SS to the plurality of pixels PX through a plurality of scan lines based on a scan control signal SCTRL received from the controller 370. In some exemplary embodiments, the scan control signal SCTRL includes, but is not limited to, a scan start signal and a scan clock signal. In some exemplary embodiments, the scan driver 330 is integrated into or formed in a peripheral portion of the display region 320 of the flexible display panel 310. In other exemplary embodiments, the scan driver 330 is implemented with one or more integrated circuits.

According to an embodiment, the gamma data storage 340 stores entire driving gamma data EDGD for the entirety of the display region 320 that has been generated by a first multi-time programming, and partial driving gamma data PDGD for a portion of the display region 320 that has been generated by a second multi-time programming. In some exemplary embodiments, as illustrated in FIG. 8, the flexible display panel 310 is the out-foldable display panel that has one folding line FL, and the partial driving gamma data PDGD is generated by driving at least one of an upper half, a lower half or a middle half of the display region 320*a* of the out-foldable display panel. In other exemplary embodiments, as illustrated in FIGS. 9A and 9B, the flexible display panel 310 has two folding lines FL1 and FL2, and the partial driving gamma data PDGD includes two-thirds driving gamma data generated by driving two-thirds of the display region 320*b* of the foldable display panel, and one-third driving gamma data generated by driving one-third of the display region 320*b* of the foldable display panel. In still other exemplary embodiments, as illustrated in FIG. 10, the flexible display panel 310 is a rollable display panel, and the partial driving gamma data PDGD includes minimum area driving gamma data generated by driving a portion of the display region 320*c* of the rollable display panel that has a predetermined minimum area.

According to an embodiment, the gamma reference voltage generator 350 is controlled based on a gamma control signal GCTRL received from the controller 370, receives the entire driving gamma data EDGD or the partial driving gamma data PDGD from the gamma data storage 340, and provides a gamma reference voltage GRV that corresponds to the entire driving gamma data EDGD or the and partial driving gamma data PDGD to the data driver 360. In some exemplary embodiments, the gamma reference voltage generator 350 provides one or more gamma reference voltages GRV for one or more reference gray levels, such as a 0-gray level, a 1-gray level, a 11-gray level, a 23-gray level, a 35-gray level, a 51-gray level, a 87-gray level, a 151-gray level, a 203-gray level or a 255-gray level, to the data driver 360.

In the flexible display device 300 according to exemplary embodiments, the gamma reference voltage generator 350 generates the gamma reference voltage GRV based on the entire driving gamma data EDGD when the flexible display panel 310 is not deformed, and generates the gamma reference voltage GRV based on the partial driving gamma data PDGD when the flexible display panel 310 is deformed. In some exemplary embodiments, the gamma control signal GCTRL represent whether the flexible display panel 310 is deformed or not deformed, and the gamma reference voltage generator 350 generates the gamma reference voltage GRV by selectively using the entire driving gamma data EDGD or the partial driving gamma data PDGD in response to the gamma control signal GCTRL. In other exemplary embodiments, the gamma control signal GCTRL includes a deformation level signal DLS representing a deformation degree of the flexible display panel 310, and the gamma reference voltage generator 350 generates the gamma reference voltage GRV based on the entire driving gamma data EDGD when the deformation level signal DLS indicates a deformation degree of 0 or less than a reference deformation degree. Further, when the deformation level signal DLS indicates a deformation degree greater than 0 or greater than or equal to the reference deformation degree, the gamma reference voltage generator 350 generates interpolated gamma data by interpolating the entire driving gamma data EDGD and the partial driving gamma data PDGD, and generate the gamma reference voltage GRV based on the interpolated gamma data.

In some exemplary embodiments, as illustrated in FIG. 8, the flexible display panel 310 is an out-foldable display panel that has one folding line FL, and the flexible display panel 310 is deformed by being out-folded. The gamma reference voltage generator 350 generate the gamma reference voltage GRV based on the entire driving gamma data EDGD when the out-foldable display panel is not folded, and generates the gamma reference voltage GRV based on the partial driving gamma data PDGD when the out-foldable display panel is folded.

In other exemplary embodiments, as illustrated in FIGS. 9A and 9B, the flexible display panel 310 is a foldable display panel that has two folding lines FL1 and FL2, and the flexible display panel 310 is deformed by being folded at one or both of the two folding lines FL1 and FL2. The gamma reference voltage generator 350 generates gamma reference voltage GFV based on the entire driving gamma data EDGD when the foldable display panel is not folded, generates the gamma reference voltage GRV based on the two-thirds driving gamma data as the partial driving gamma data PDGD when the foldable display panel is folded at one of the two folding lines FL1 and FL2, and generates the gamma reference voltage GRV based on the one-third driving gamma data as foe partial driving gamma data PDGD when the foldable display panel is folded at both of foe two folding lines FL1 and FL2.

In still other exemplary embodiments, as illustrated in FIG. 10, the flexible display panel 310 is a rollable display panel, and the flexible display panel 310 is deformed by being rolled. The gamma reference voltage generator 350 generates gamma reference voltage GRV based on the entire driving gamma data EDGD when the rollable display panel is unrolled. Further, when the rollable display panel is rolled, the gamma reference voltage generator 350 generates interpolated gamma data by interpolating the minimum area driving gamma data as the partial driving gamma data PDGD and the entire driving gamma data EDGD, and generates the gamma reference voltage GRV based on the interpolated gamma data. For example, in generating the interpolated gamma data, as the exposed portion of the display region 320 decreases, the gamma reference voltage generator 350 increases a weight for the minimum area driving gamma data or the partial driving gamma data PDGD, and decreases a weight for the entire driving gamma data EDGD.

According to an embodiment, the data driver 360 provides data voltages DV to the plurality of pixels PX through a plurality of data lines based on output image data ODAT and a data control signal DCTRL received from the controller 370. In some exemplary embodiments, the data control signal DCTRL includes, but is not limited to, a horizontal start signal and a load signal. The data driver 360 receives the gamma reference voltage GRV from the gamma reference voltage generator 350, and provides the data voltages DV to the plurality of pixels PX of the flexible display panel 310 based on the gamma reference voltage GRV. For example, 256 gamma voltages at 256 gray levels are generated based on the gamma reference voltage GRV at the one or more reference gray levels, such as the 0-gray level, the 1-gray level, the 11-gray level, the 23-gray level, the 35-gray level, the 51-gray level, the 87-gray level, the 151-gray level, the 203-gray level and the 255-gray level, and the data driver 360 selects the gamma voltages at gray levels represented by the output image data ODAT as the data voltages DV from among the 256 gray levels.

According to an embodiment, the controller 370, such as a timing controller (TCON), receives input image data IDAT and a control signal CTRL from an external host processor, such as a graphic processing unit (GPU) or a graphic card. In some exemplary embodiments, the input image data IDAT is RGB image data that includes red image data, green image data and blue image data. The controller 370 controls operations of the scan driver 330, the gamma reference voltage generator 350 and the data driver 360 based on the control signal CTRL and the input image data IDAT. In some exemplary embodiments, the gamma data storage 340, the gamma reference voltage generator 350, the data driver 360 and the controller 370 are implemented with a single integrated circuit. For example, the single integrated circuit may be referred to as a timing controller embedded data driver (TED). In other exemplary embodiments, the gamma data storage 340, the gamma reference voltage generator 350, the data driver 360 and the controller 370 are implemented with two or more separate integrated circuits.

According to an embodiment, the control signal CTRL received from the host processor includes deformation information DFI of the flexible display panel 310, and the controller 370 controls toe gamma reference voltage generator 350 based on the deformation information DFI. In some exemplary embodiments, the control signal CTRL further includes, but is not limited to, a vertical synchronization signal, a horizontal synchronization signal, an input data enable signal, a master clock signal, etc.

In some exemplary embodiments, the deformation information DFI of the flexible display panel 310 indicates whether the flexible display panel 310 is deformed or not. The controller 370 controls toe gamma reference voltage generator 350 to generate toe gamma reference voltage GRV based on the entire driving gamma data EDGD when the deformation information DFI indicates that the flexible display panel 310 is not deformed, and control the gamma reference voltage generator 350 to generate the gamma reference voltage GRV based on the partial driving gamma data PDGD when the deformation information DFI indicates that the flexible display panel 310 is deformed.

Figure 13:
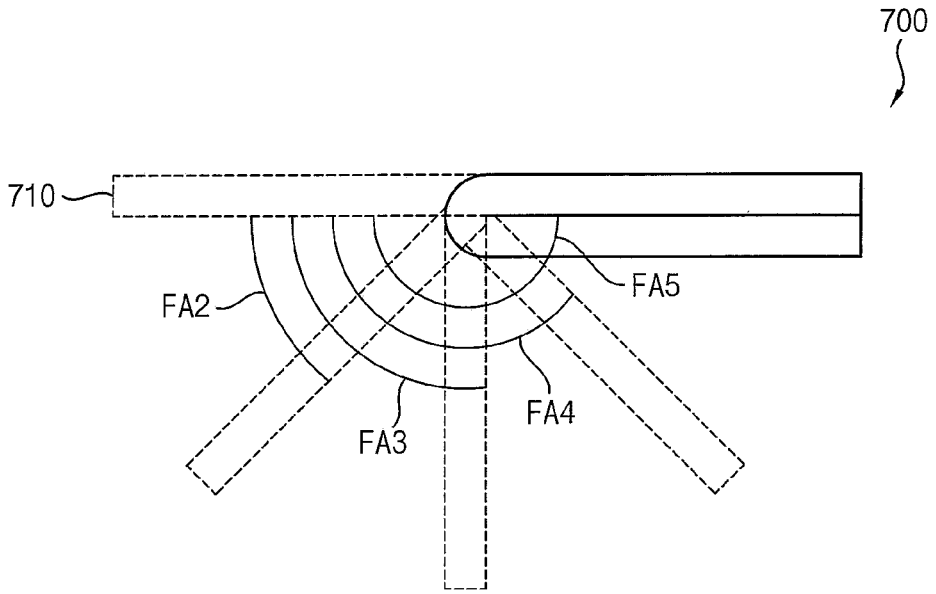
FIG. 13 illustrates examples of deformation degrees of a flexible display device that includes an out-foldable display panel.

In other exemplary embodiments, the deformation information DFI for the flexible display panel 310 indicates a deformation degree of the flexible display panel 310. For example, as illustrated in FIG. 13, the flexible display panel 310 is an out-foldable display panel of an out-foldable display device 700, and the deformation degree indicated by the deformation information DFI corresponds to a folding angle FA2, FA3, FA4 and FA5 of foe out-foldable display panel. The controller 370 provides a deformation level signal DLS that corresponds to foe deformation degree to foe gamma reference voltage generator 350. The gamma reference voltage generator 350 generates interpolated gamma data by interpolating foe partial driving gamma data PDGD and foe entire driving gamma data EDGD based on foe deformation level signal DLS, and generates foe gamma reference voltage GRV based on foe interpolated gamma data. For example, foe gamma reference voltage generator 350 multiplies foe partial driving gamma data PDGD by a first weight that gradually or continuously increases as foe deformation degree increases, multiplies the entire driving gamma data EDGD by a second weight that gradually or continuously decreases as the deformation degree increases, and generates foe interpolated gamma data by dividing a sum of the partial driving gamma data PDGD multiplied by foe first weight and the entire driving gamma data EDGD multiplied by the second weight by a sum of foe first weight and the second weight. Further, in some exemplary embodiments, based on the deformation information DFI, foe controller 370 gradually or continuously reduces foe luminance of foe output image data ODAT for an unviewed portion of the display region 320 such that foe luminance of foe unviewed portion of foe display region 320 gradually or continuously reduces as the deformation degree of the flexible display panel 310 increases. Accordingly, as the deformation degree of the flexible display panel 310 increases, a loading of the flexible display panel 310 gradually or continuously changes, and luminance of the flexible display panel 310 does not instantaneously change but rather gradually or continuously changes from the non-deformed state to the deformed state.

According to an embodiment, if the flexible display panel 310 is deformed such that a partial region of the flexible display panel 310 can be viewed by a user, but the remaining region of the flexible display panel 310 cannot be viewed by a user, only the partial region of the flexible display panel 310 viewable by a user is driven to reduce power consumption. However, if the flexible display device 300 uses single gamma data, a loading of the flexible display panel 310, of which only the partial region viewable by a user is driven, can be reduced as compared with a loading of the flexible display panel 310 of which the entire region is driven, and thus luminance of the flexible display panel 310 of which only the partial region is driven can be increased compared with desired luminance.

However, in the flexible display device 300 according to exemplary embodiments, the gamma data storage 340 stores not only the entire driving gamma data EDGD generated by the first multi-time programming for the entirety of the display region 320, but also the partial driving gamma data PDGD generated by the second multi-time programming for the portion of the display region 320, and the gamma reference voltage generator 350 generates the gamma reference voltage GRV based on the entire driving gamma data EDGD when the flexible display panel 310 is not deformed, and generates the gamma reference voltage GRV based on the partial driving gamma data PDGD when the flexible display panel 310 is deformed. Accordingly, in the flexible display device 300 according to exemplary embodiments, when the flexible display panel 310 is deformed, an undesired increased luminance can be prevented, and power consumption of the flexible display device 300 can be reduced.

Figure 7:
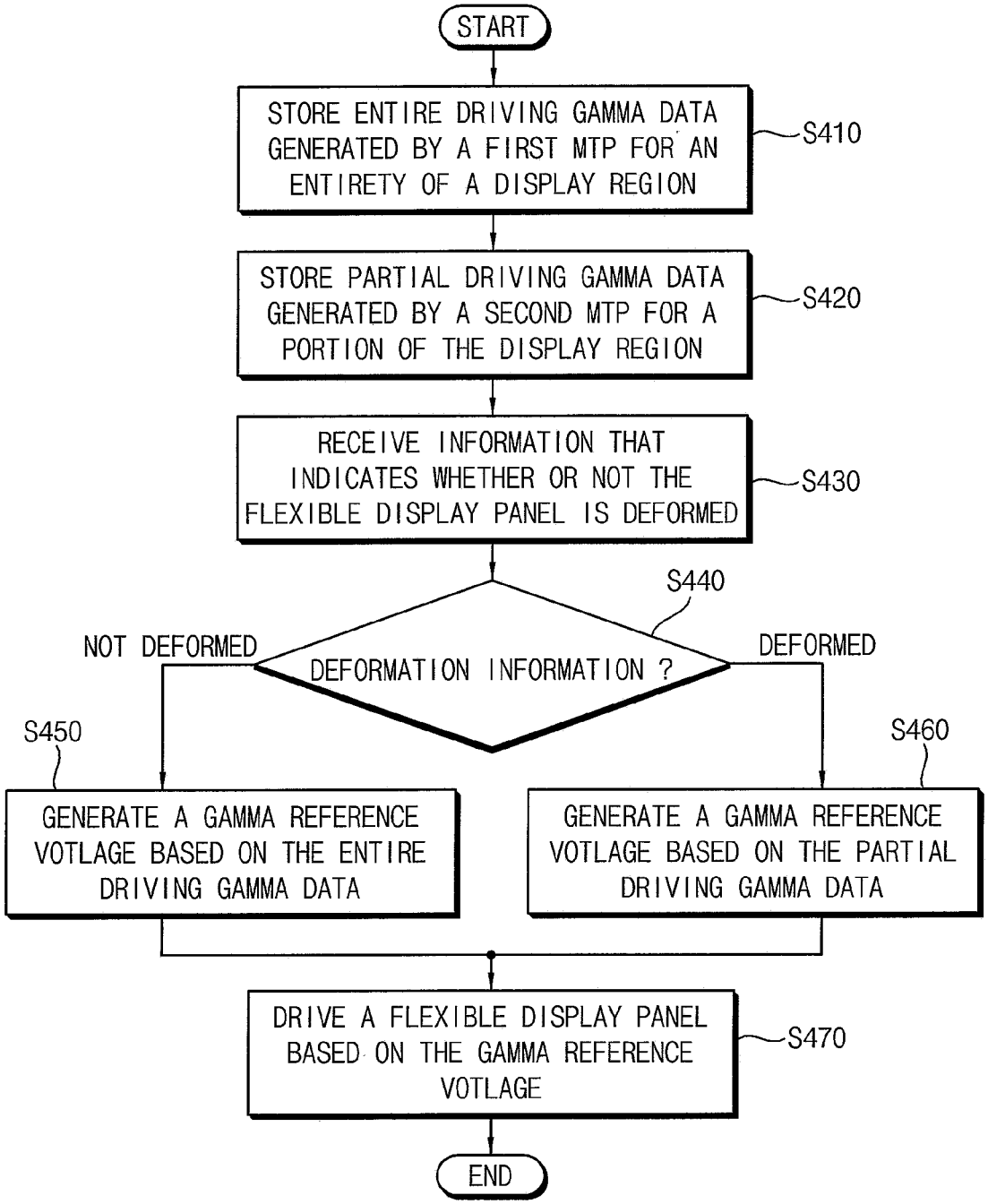
FIG. 7 is a flowchart of a method of operating a flexible display device according to exemplary embodiments.

FIG. 7 is a flowchart of a method of operating a flexible display device according to exemplary embodiments, FIG. 8 illustrates an example of a flexible display device that includes an out-foldable display panel when it is deformed, FIGS. 9A and 9B illustrate examples of a flexible display device that includes a deformed foldable display panel that has two folding lines, FIG. 10 illustrates examples of a flexible display device that includes a reliable display panel when it is both deformed and not-deformed, and FIG. 11 illustrates tables of luminance and power consumption of a flexible display device that uses single gamma data and luminance and power consumption of a flexible display device that uses entire driving gamma data and partial driving gamma data.

Referring to FIGS. 6 and 7, according to an embodiment, in a method of operating a flexible display device 300, a gamma data storage 340 stores entire driving gamma data EDGD generated by a first multi-time programming for the entirety of a display region 320 (S410). The gamma data storage 340 further stores partial driving gamma data PDGD generated by a second multi-time programming for a portion of the display region 320 (S420).

According to an embodiment, a controller 370 receives deformation information DFI that indicates whether or not the flexible display panel 310 is deformed (S430). When the deformation information DFI indicates that the flexible display panel 310 is not deformed (S440: NOT DEFORMED), the controller 370 controls a gamma reference voltage generator 350 to generate a gamma reference voltage GRV based on the entire driving gamma data EDGD (S450). The data driver 360 drives the flexible display panel 310 based on the gamma reference voltage GRV that corresponds to the entire driving gamma data EDGD, and the flexible display panel 310 displays an image (S470).

According to an embodiment, when the deformation information DFI indicates that the flexible display panel 310 is deformed (S440: DEFORMED), the controller 370 controls the gamma reference voltage generator 350 to generate the gamma reference voltage GEV based on the partial driving gamma data PDGD (S460). The data driver 360 drives the flexible display panel 310 based on the gamma reference voltage GRV that corresponds to the partial driving gamma data PDGD, and the flexible display panel 310 displays an image (S470).

In some exemplary embodiments, as illustrated in FIG. 5, the flexible display device 300 is an out-foldable display device 300*a* that has one folding line FL. As illustrated in FIG. 8, when an out-foldable display panel of the out-foldable display device 300*a* is deformed, or when the out-foldable display panel is folded such that only the portion 322*a* of the display region 320*a* is viewable by a user, the gamma reference voltage generator 350 generates the gamma reference voltage GRV based on the partial driving gamma data PDGD, and the data driver 360 drives only the portion 322*a* of the display region 320*a* based on the gamma reference voltage GRV that corresponds to the partial driving gamma data PDGD. In some exemplary embodiments, no data voltages DV, or data voltages DV that correspond to a black image, are provided to the remaining portion of the display region 320*a* that is not viewable by a user.

In other exemplary embodiments, as illustrated in FIGS. 9A and 9B, the flexible display device 300 is a foldable display device 300*b* that has two folding lines FL1 and FL2. As illustrated in FIG. 9A, when a foldable display panel of the foldable display device 300*b* is deformed, or when the foldable display panel is folded at around one folding line FL2 of the two folding lines FL1 and FL2 such that two-thirds 322*b* and 324*b* of the display region 320*b* of the foldable display panel can be viewed by a user, the gamma reference voltage generator 350 generates the gamma reference voltage GRV based on two-thirds driving gamma data as the partial driving gamma data PDGD, and the data driver 360 drives only the two-thirds 322*b* and 324*b* of the display region 320*b* based on the gamma reference voltage GRV that corresponds to the two-thirds driving gamma data. In some exemplary embodiments, no data voltages DV, or data voltages DV that correspond to a black image, are provided to the remaining one-third 326*b* of the display region 320*b* that is not viewable by a user. Further, as illustrated in FIG. 9B, when the foldable display panel is deformed, or when the foldable display panel is folded at both of the two folding lines FL1 and FL2 such that the one-third 326*b* of the display region 320*b* can be viewed by a user, the gamma reference voltage generator 350 generates the gamma reference voltage GRV based on one-third driving gamma data as the partial driving gamma data PDGD, and the data driver 360 drives only the one-third 326*b* of the display region 320*b* based on the gamma reference voltage GRV that corresponds to the one-third driving gamma data. In some exemplary embodiments, no data voltages DV, or data voltages DV that correspond to a black image are provided to the remaining two-thirds 322*b* and 324*b* of the display region 320*b* that are not viewable by a user.

In still other exemplary embodiments, as illustrated in FIG. 10, the flexible display device 300 is a reliable display device 300*c*, 300*d* and 300*e*. In the reliable display device 300*c* where a reliable display panel is unrolled such that the entirety of die display region 320*c* can be viewed by a user, the gamma reference voltage GRV is generated based on the entire driving gamma data EDGD. In the reliable display device 300*d* where the reliable display panel is rolled such that the portion 320*d* of the display region 320*c* can be viewed by a user, the gamma reference voltage generator 350 generates interpolated gamma data by interpolating minimum area driving gamma data as the partial driving gamma data PDGD and the entire driving gamma data EDGD, and generates the gamma reference voltage GRV based on the interpolated gamma data. The data driver 360 drives only the portion 320*d* of the display region 320*c* based on the gamma reference voltage GRV dial corresponds to the interpolated gamma data. In the rollable display device 300*e* where the rollable display panel is rolled such that the portion 320*e* of the display region 320*c* is viewable by a user, the gamma reference voltage generator 350 generates the gamma reference voltage GRV based on the minimum area driving gamma data, and the data driver 360 drives only the portion 320*e* of the display region 320*c* based on the gamma reference voltage GRV that corresponds to the minimum area driving gamma data.

If single gamma data are used, as illustrated in a table 510 of FIG. 11, the deformed out-foldable display device 300*a* illustrated in FIG. 8 emits light at a luminance of about 453 nit, as compared to a luminance of about 420 nit when not deformed, and the deformed foldable display device 300*b* illustrated in FIG. 9B emits light at a luminance of about 475 nit, as compared to a luminance of about 420 nit when not deformed. However, as for the flexible display device 300 according to exemplary embodiments, as illustrated in a table 530 of FIG. 11, each of the deformed out-foldable display device 300*a* illustrated in FIG. 8 and the deformed foldable display device 300*b* illustrated in FIG. 9B emits light at a luminance of about 420 nit, which is substantially the same as the luminance of about 420 nit when not deformed.

Accordingly, a display quality of the deformed flexible display device 300 according to exemplary embodiments is improved. Further, as illustrated in the tables 510 and 530 of FIG. 11, power consumption of the deformed out-foldable display device 300*a* illustrated in FIG. 8 decreases from about 58% to about 54% as compared with the power consumption when not deformed, and power consumption of the deformed foldable display device 300*b* illustrated in FIG. 9B decreases from about 42% to about 37% as compared with the power consumption when not deformed. Accordingly, the power consumption of the deformed flexible display device 300 according to exemplary embodiments is reduced.

Figure 12:
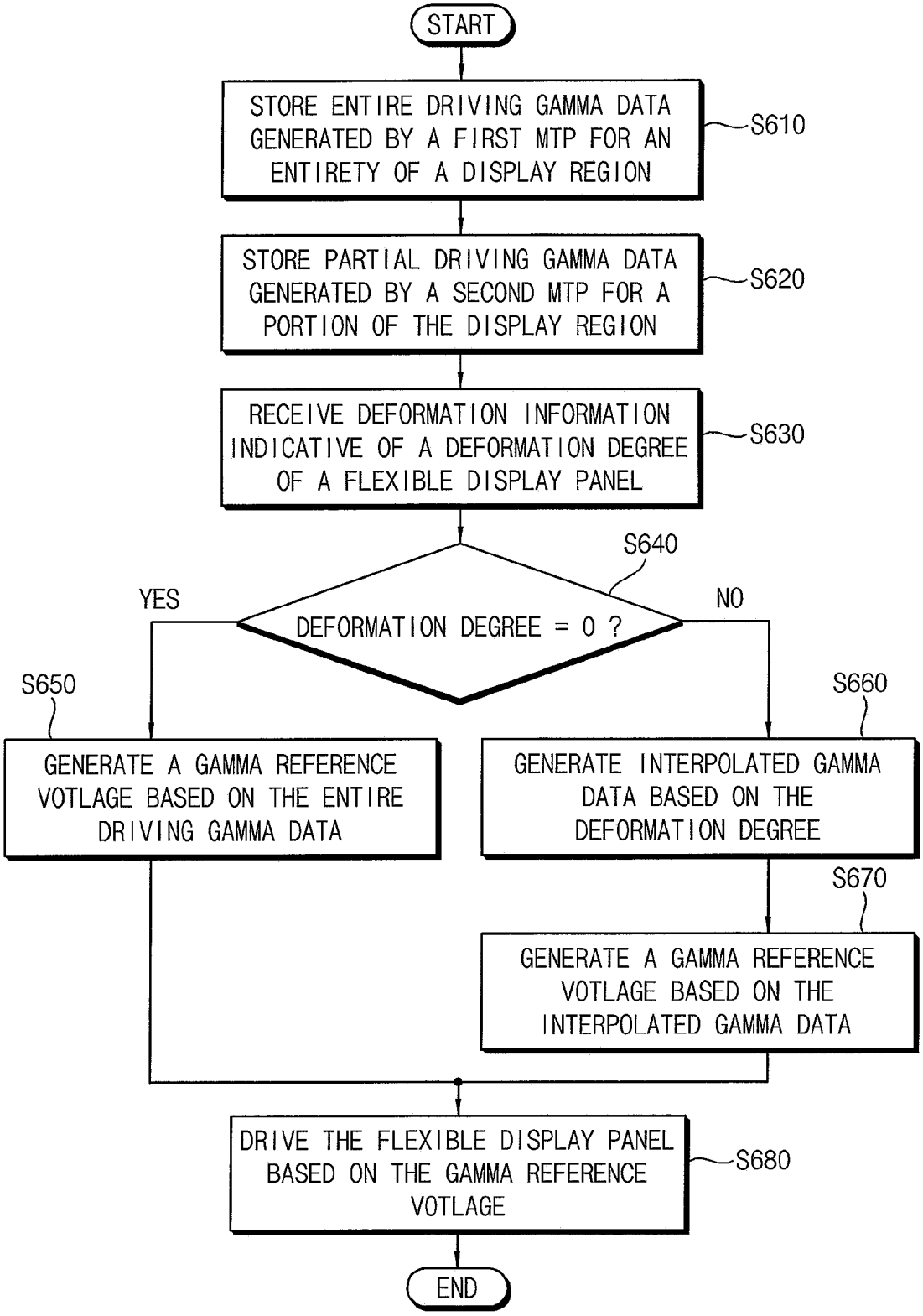
FIG. 12 is a flowchart of a method of operating a flexible display device according to exemplary embodiments.
Figure 14:
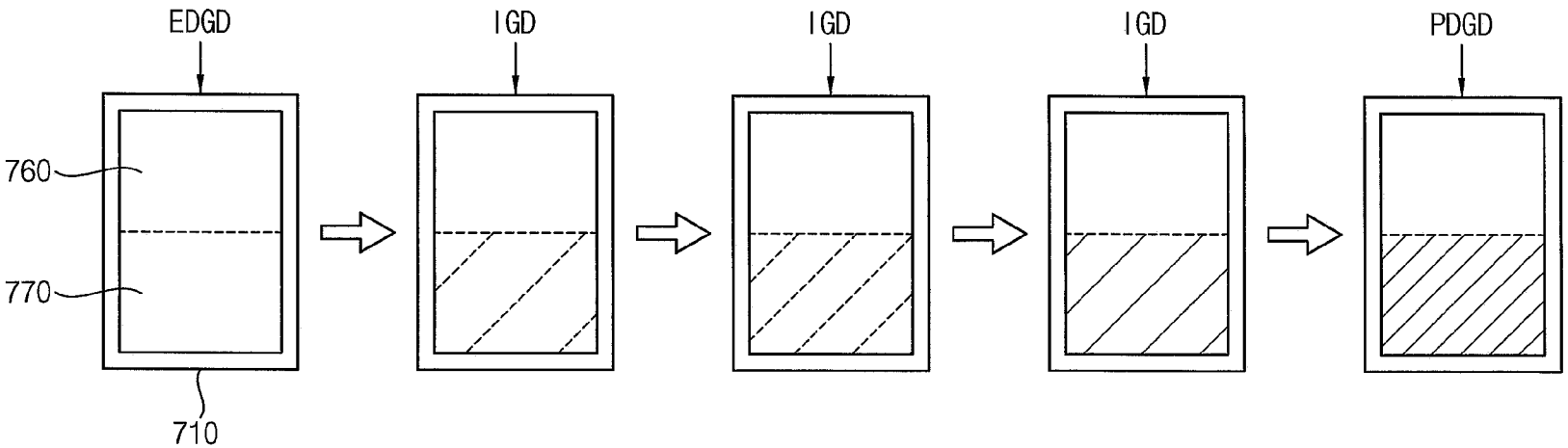
FIG. 14 illustrates an example of an out-foldable display panel being driven using gamma data that are interpolated according to deformation degrees illustrated in FIG. 13.

FIG. 12 is a flowchart of a method of operating a flexible display device according to exemplary embodiments, FIG. 13 illustrates examples of deformation degrees of a flexible display device that includes an out-foldable display panel, and FIG. 14 illustrates an example where an out-foldable display panel is driven using gamma data that are interpolated according to deformation degrees illustrated in FIG. 13.

Referring to FIGS. 6 and 12, according to an embodiment, in a method of operating a flexible display device 300, a gamma data storage 340 stores entire driving gamma data EDGD generated by a first multi-time programming for the entirety of a display region 320 of a flexible display panel 310 (S610). The gamma data storage 340 further stores partial driving gamma data PDGD generated by a second multi-time programming for a portion of die display region 320 (S620).

According to an embodiment, a controller 370 receives deformation information DFI indicative of a deformation degree of the flexible display panel 310 (S630). When the deformation information DFI indicates the deformation degree of 0 (S640: YES), the controller 370 controls a gamma reference voltage generator 350 to generate a gamma reference voltage GRV based on the entire driving gamma data EDGD (S650). A data driver 360 drives the flexible display panel 310 based on the gamma reference voltage GRV corresponding to the entire driving gamma data EDGD, and the flexible display panel 310 displays an image (S680).

According to an embodiment, when the deformation information indicates that the deformation degree greater than 0 or greater than or equal to a reference deformation degree (S640: NO), the controller 370 provides a deformation level signal DLS indicating the deformation degree to the gamma reference voltage generator 350, and the gamma reference voltage generator 350 generates interpolated gamma data by interpolating the partial driving gamma data PDGD and the entire driving gamma data EDGD based on the deformation degree indicated by the deformation level signal DLS (S660). In some exemplary embodiments, the gamma reference voltage generator 350 multiplies the partial driving gamma data PDGD by a first weight that gradually or continuously increases as the deformation degree increases, multiplies the entire driving gamma data EDGD by a second weight that gradually or continuously decreases as the deformation degree increases, and generates the interpolated gamma data by dividing a sum of the partial driving gamma data PDGD multiplied by the first weight and the entire driving gamma data EDGD multiplied by the second weight by a sum of the first weight and the second weight. The gamma reference voltage generator 350 generates the gamma reference voltage GRV based on the interpolated gamma data (S670), the data driver 360 drives the flexible display panel 310 based on the gamma reference voltage GRV corresponding to the interpolated gamma data, and the flexible display panel 310 displays an image (S680).

In some exemplary embodiments, as illustrated in FIGS. 13 and 14, the flexible display device 300 is an out-foldable display device 700, and the deformation degree indicated by the deformation information DFI is a folding angle FA2, FA3, FA4 and FA5 of an out-foldable display panel 710 of the out-foldable display device 700. For example, with respect to the out-foldable display panel 710 having the folding angle of about 0 degree, an upper half 760 of a display region of the out-foldable display panel 710 is driven based on the gamma reference voltage GRV that corresponds to the entire driving gamma data EDGD. With respect to the out-foldable display panel 710 having the folding angle FA5 of about 180 degree, the upper half 760 of the display region of the out-foldable display panel 710 is driven based on the gamma reference voltage GRV that corresponds to the partial driving gamma data PDGD. No data voltages DV, or data voltages DV that correspond to a black image are provided to the lower half 770 of the display region of the out-foldable display panel 710.

Further, according to an embodiment, as illustrated in FIGS. 13 and 14, when the folding angle FA2, FA3 and FA4 of the out-foldable display panel 710 is greater than about 0 degree, which corresponds to a non-deformed state, and less than about 180 degree, which corresponds to a fully deformed state, the out-foldable display panel 710 is driven based on the gamma reference voltage GRV that corresponds to the interpolated gamma data IGD generated by interpolating the partial driving gamma data PDGD and the entire driving gamma data EDGD. For example, as illustrated in FIG. 14, the partial driving gamma data PDGD is multiplied by the first weight W1 that gradually or continuously increases as the deformation degree increases, the entire driving gamma data EDGD is multiplied by the second weight W2 that gradually or continuously decreases as the deformation degree increases, and the interpolated gamma data IGD is generated by dividing a sum of the partial driving gamma data PDGD multiplied by the first weight W1 and the entire driving gamma data EDGD multiplied by the second weight W2 by a sum of the first weight W1 and the second weight W2.

Further, in some exemplary embodiments, as illustrated in FIGS. 13 and 14, the controller 370 gradually or continuously decreases output image data ODAT for an unviewable portion 770, such as the lower half 770, of the display region such that luminance of the unviewed portion 770 of the display region gradually or continuously decreases as the folding angle FA2, FA3, FA4 and FA5 of the out-foldable display panel 710 increases. Accordingly, as the folding angle FA2, FA3, FA4 and FA5 of the out-foldable display panel 710 increases, a loading of the out-foldable display panel 710 gradually or continuously changes, and luminance of the out-foldable display panel 710 does not instantaneously changed but rather gradually or continuously changes between the non-deformed state and the fully deformed state.

As described above, according to an embodiment, when the flexible display device 310 changes from a non-deformed state to a folly deformed state, gamma data used in the flexible display device 300 gradually or continuously changes from the entire driving gamma data EDGD to the partial driving gamma data PDGD, and the output image data ODAT for foe unviewable portion of the display region gradually or continuously decreases, thereby preventing an instantaneous change of luminance.

Figure 15:
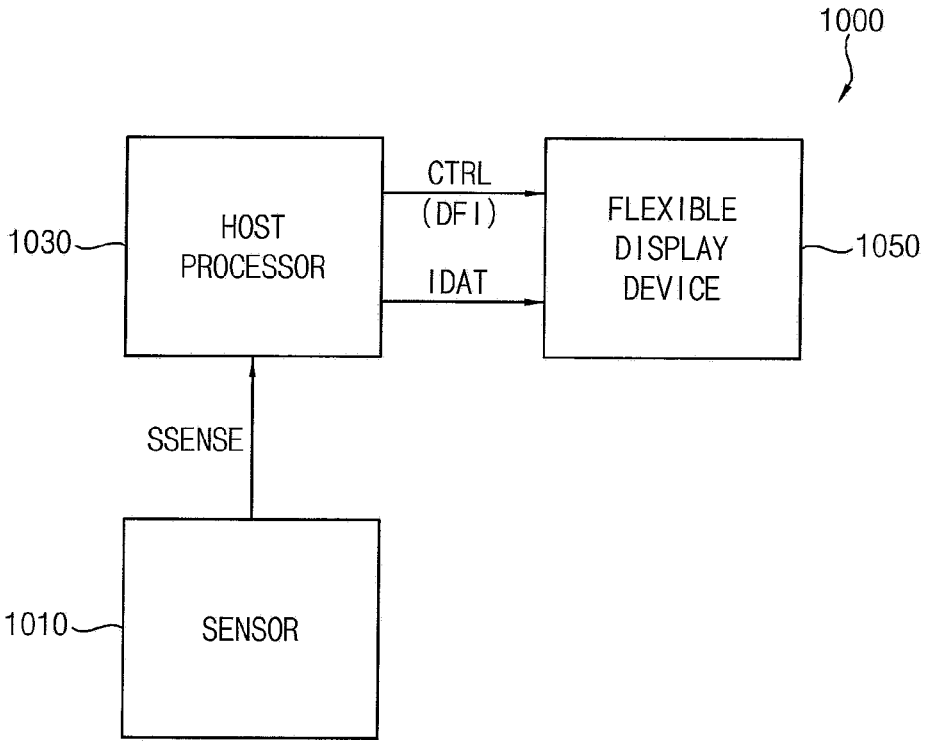
FIG. 15 is a block diagram of an electronic device that includes a flexible display device according to exemplary embodiments.

FIG. 15 is a block diagram of an electronic device that includes a flexible display device according to exemplary embodiments.

Referring to FIG. 15, an electronic device 1000 according to exemplary embodiments includes a sensor 1010, a host processor 1030 and a flexible display device 1050. In some exemplary embodiments, the electronic device 1000 further includes a memory device, a storage device, an input/output (I/O) device, a power supply, etc.

According to an embodiment, the sensor 1010 senses a deformation state or a deformation degree of the flexible display device 1050, and may provide a sense signal SSENSE indicative of the deformation state or the deformation degree to foe host processor 1030. For example, foe sense signal SSENSE indicates whether or not a flexible display panel of foe flexible display device 1050 is deformed, or indicates the deformation degree of the flexible display panel.

According to an embodiment, the host processor 1030 can perform various computing functions or tasks. The host processor 1030 can be an application processor (AP) that includes a graphic processing unit (GPU), a central processing unit (CPU), a micro processor, etc. The host processor 1030 provides a control signal CTRL and input image data IDAT to the flexible display device 1050. In some exemplary embodiments, based on the sense signal SSENSE from the sensor 1010, the host processor 1030 provides to the flexible display device 1050 deformation information DFI indicative of whether or not the flexible display panel is deformed. In other exemplary embodiments, based on the sense signal SSENSE from the sensor 1010, the host processor 1030 provides to the flexible display device 1050 the deformation information DFI that indicates the deformation degree of the flexible display panel.

According to an embodiment, the flexible display device 1050 displays an image based on the control signal CTRL and the input image data IDAT. The flexible display device 1050 stores not only entire driving gamma data generated by a first multi-time programming for the entirety of a display region, but also partial driving gamma data generated by a second multi-time programming for a portion of the display region. The flexible display device 1050 generates a gamma reference voltage based on the entire driving gamma data when the flexible display panel is not deformed, and generates the gamma reference voltage based on the partial driving gamma data when the flexible display panel is deformed. Accordingly, an undesirable increase of the luminance of the flexible display panel can be prevented when it is deformed, and power consumption of the flexible display device 1050 can be reduced.

Embodiments of the inventive concepts can be incorporated into any electronic device 1000, such as a mobile phone, a smart phone, a tablet computer, a television (TV), a digital TV, a 3D TV, a wearable electronic device, a personal computer (PC), a home appliance, a laptop computer, a personal digital assistant (PDA), a portable multimedia player (PMP), a digital camera, a music player, a portable game console, or a navigation device, etc.

The foregoing is illustrative of embodiments and is not to be construed as limiting thereof. Although a few exemplary embodiments have been described, those skilled in the art will readily appreciate that many modifications are possible in exemplary embodiments without materially departing from the novel teachings of embodiments of the present inventive concept. Accordingly, all such modifications are intended to be included within the scope of embodiments of the present inventive concept as defined in the claims. Therefore, it is to be understood that the foregoing is illustrative of various exemplary embodiments and is not to be construed as limited to the specific exemplary embodiments disclosed, and that modifications to exemplary embodiments, as well as other embodiments, are intended to be included within the scope of the appended claims.

What is claimed is:

1. A flexible display device, comprising:

a flexible display panel that includes a display region;

a gamma data storage that stores entire driving gamma data generated by a first multi-time programming for an entirety of the display region, and partial driving gamma data generated by a second multi-time programming for a portion of the display region, wherein when the flexible display pawl is deformed, the portion of the display region is a region that is deformed;

a gamma reference voltage generator that generates a gamma reference voltage based on the entire driving gamma data when the flexible display panel is not deformed, and generates the gamma reference voltage based on the partial driving gamma data when the flexible display panel is deformed; and a data driver that provides data voltages to the entirety of the display region when the flexible display panel is not deformed, and to the portion of the display region when the flexible display panel is deformed, based on the gamma reference voltage.

2. The flexible display device of claim 1, wherein the flexible display panel is an out-foldable display panel, and wherein a deformed state of the flexible display panel is a state where the out-foldable display panel is folded.

3. The flexible display device of claim 2, wherein the partial driving gamma data are generated by driving one of an upper half, a lower half or a middle half of the display region of the out-foldable display panel.

4. The flexible display device of claim 2, wherein the gamma reference voltage generator generates the gamma reference voltage based on the entire driving gamma data when the out-foldable display panel is not folded, and generates the gamma reference voltage based on the partial driving gamma data when the out-foldable display panel is folded.

5. The flexible display device of claim 1, wherein the flexible display panel is a foldable display panel that has two folding lines, and wherein a deformed state of the flexible display panel is a state where the foldable display panel is folded around at least one of the two folding lines.

6. The flexible display device of claim 5, wherein the partial driving gamma data includes:

two-thirds driving gamma data generated by driving two-thirds of the display region of the foldable display panel; and one-third driving gamma data generated by driving one-third of the display region of the foldable display panel.

7. The flexible display device of claim 6, wherein the gamma reference voltage generator generates the gamma reference voltage based on the entire driving gamma data when the foldable display panel is not folded, generates the gamma reference voltage based on the two-thirds driving gamma data when the foldable display panel is folded at one of the two folding lines, and generates the gamma reference voltage based on the one-third driving gamma data when the foldable display panel is folded at both of the two folding lines.

8. The flexible display device of claim 1, wherein the flexible display panel is a rollable display panel, and wherein a deformed state of the flexible display panel is a state where the rollable display panel is rolled.

9. The flexible display device of claim 8, wherein the partial driving gamma data includes:

minimum area driving gamma data generated by driving a portion of the display region of the rollable display panel, wherein the portion of the display region has a predetermined minimum area.

10. The flexible display device of claim 9, wherein the gamma reference voltage generator generates the gamma reference voltage based on the entire driving gamma data when the rollable display panel is unrolled, and when the rollable display panel is rolled, the gamma reference voltage generator generates interpolated gamma data by interpolating the minimum area driving gamma data and the entire driving gamma data, and generates the gamma reference voltage based on the interpolated gamma data.

11. The flexible display device of claim 1, further comprising:

a controller that receives deformation information indicative of whether or not the flexible display panel is deformed, and to control the gamma reference voltage generator based on the deformation information.

12. The flexible display device of claim 1, further comprising:

a controller that receives deformation information indicative of a deformation degree of the flexible display panel, and to provide to the gamma reference voltage generator a deformation level signal that corresponds to the deformation degree.

13. The flexible display device of claim 12, wherein the flexible display panel is an out-foldable display panel, and wherein the deformation degree indicated by the deformation information corresponds to a folding angle of the out-foldable display panel.

14. The flexible display device of claim 12, wherein the gamma reference voltage generator generates interpolated gamma data by interpolating the partial driving gamma data and the entire driving gamma data based on the deformation level signal, and generates the gamma reference voltage based on the interpolated gamma data.

15. The flexible display device of claim 14, wherein the gamma reference voltage generator multiplies the partial driving gamma data by a first weight that continuously increases as the deformation degree increases, multiplies the entire driving gamma data by a second weight that continuously decreases as the deformation degree increases, and generates the interpolated gamma data by dividing a sum of the partial driving gamma data multiplied by the first weight and the entire driving gamma data multiplied by the second weight by a sum of the first weight and the second weight.

16. The flexible display device of claim 12, wherein the controller continuously decreases image data for an unviewable portion of the display region such that a luminance of the unviewable portion of the display region continuously decreases as the deformation degree of the flexible display panel increases.

17. A method of operating a flexible display device that includes a flexible display panel that includes a display region, the method comprising:

storing entire driving gamma data generated by a first multi-time programming for an entirety of the display region;

storing partial driving gamma data generated by a second multi-time programming for a portion of the display region that is not deformed when the flexible display panel is deformed;

receiving deformation information indicative of whether or not the flexible display panel is deformed;

generating a gamma reference voltage based on the entire driving gamma data when the deformation information indicates that the flexible display panel is not deformed;

generating the gamma reference voltage based on the partial driving gamma data when the deformation information indicates that the flexible display panel is deformed; and driving the flexible display panel based on the gamma reference voltage wherein an image is displayed, wherein the entirety of the display region is driven when the flexible display panel is not deformed, and the non-deformed portion of the display region is driven when the flexible display panel is deformed.

18. A method of operating a flexible display device that includes a flexible display panel that includes a display region, the method comprising:

storing entire driving gamma data generated by a first multi-time programming for an entirety of the display region;

storing partial driving gamma data generated by a second multi-time programming for a portion of the display region that is not deformed when the flexible display panel is deformed;

receiving deformation information indicative of a deformation degree of the flexible display panel;

generating a gamma reference voltage based on the entire driving gamma data when the deformation information indicates that the deformation degree is 0;

generating interpolated gamma data by interpolating the partial driving gamma data and the entire driving gamma data based on the deformation degree when the deformation information indicates that the deformation degree is not equal to 0;

generating the gamma reference voltage based on the interpolated gamma data; and driving the flexible display panel based on the gamma reference voltage wherein an image is displayed, wherein the entirety of the display region is driven when the flexible display pawl is not deformed, and the non-deformed portion of the display region is driven when the flexible display panel is deformed.

19. The method of claim 18, wherein generating the interpolated gamma data includes:

multiplying the partial driving gamma data by a first weight that continuously increases as the deformation degree increases;

multiplying the entire driving gamma data by a second weight that continuously decreases as the deformation degree increases; and generating the interpolated gamma data by dividing a sum of the partial driving gamma data multiplied by the first weight and the entire driving gamma data multiplied by the second weight by a sum of the first weight and the second weight.

20. The method of claim 18, further comprising:

continuously decreasing image data for an unviewable portion of the display region such that a luminance of the unviewable portion of the display region continuously decreases as the deformation degree of the flexible display panel increases.

* * * * *